US011060243B2

(12) United States Patent
Schäper

(10) Patent No.: US 11,060,243 B2
(45) Date of Patent: Jul. 13, 2021

(54) PROFILED BEARING AND RAIL SYSTEM

(71) Applicant: LOSYCO GMBH, Bielefeld (DE)

(72) Inventor: Franz Werner Schäper, Halle (DE)

(73) Assignee: LOSYCO GMBH, Bielefeld (DE)

( * ) Notice: Subject to any disclaimer, the term of this patent is extended or adjusted under 35 U.S.C. 154(b) by 328 days.

(21) Appl. No.: 16/092,643

(22) PCT Filed: Mar. 10, 2017

(86) PCT No.: PCT/EP2017/055688
§ 371 (c)(1),
(2) Date: Oct. 10, 2018

(87) PCT Pub. No.: WO2017/178158
PCT Pub. Date: Oct. 19, 2017

(65) Prior Publication Data

US 2019/0127922 A1 May 2, 2019

(30) Foreign Application Priority Data

Apr. 14, 2016 (DE) ..... 102016106941.8

(51) Int. Cl.
*E01B 9/60* (2006.01)
*E01B 25/28* (2006.01)
*E01B 25/00* (2006.01)

(52) U.S. Cl.
CPC ..... *E01B 9/60* (2013.01); *E01B 25/00* (2013.01); *E01B 25/28* (2013.01)

(58) Field of Classification Search
CPC . E01B 25/00; E01B 25/28; E01B 9/60; E01B 5/08; E01B 26/00; E01B 9/62;
(Continued)

(56) References Cited

U.S. PATENT DOCUMENTS 9,109,617 B2 * 8/2015 Diep ..... F16B 21/075
9,494,258 B2 * 11/2016 Flynn ..... F16L 3/13
(Continued)

FOREIGN PATENT DOCUMENTS

CN 202259336 U 5/2012
CN 102803753 11/2012
(Continued)

OTHER PUBLICATIONS

Search Report issued in Int'l App. No. PCT/EP2017/055688 (2017).

*Primary Examiner* — Mark T Le
(74) *Attorney, Agent, or Firm* — Barnes & Thornburg LLP

(57) ABSTRACT

A profiled bearing for a rail and a rail system are disclosed. The profiled bearing has a profiled base with a first lateral wall, a second lateral wall, and a base which connects a first end of the first lateral wall to a first end of the second lateral wall, and the profiled bearing also has a profiled clamping section. The base and the lateral walls form a receiving pocket for receiving the rail. In a functional position, the profiled clamping section is clamped in a gap between the rail inserted into a bearing bed of the base and the second lateral wall. A clamping finger which extends in the direction of the second lateral wall is molded in the region of a second end of the first lateral wall, the end being arranged at a distance from the base, wherein the rail can be pressed into the bearing bed by means of the clamping finger, and the profiled clamping section has a base web with two clamping limbs which extend from one face of the base web and which can be pressed into the gap between the rail inserted into the bearing bed and the second lateral wall. The clamping limbs of the profiled clamping section extend in the direction of the bearing bed in the functional position in which the clamping limbs are inserted into the gap, and a first clamping limb lies
(Continued)

against the rail at least in some regions and a part of a second clamping limb is pressed into an undercut formed on the second lateral wall.

12 Claims, 5 Drawing Sheets

(58) Field of Classification Search
CPC . E01B 23/00; E01B 23/04; B66C 7/08; B66C 7/00; B66C 7/02; B66C 9/08; F16C 29/045; F16C 29/005; F16C 3/13; B60L 5/40; F16L 3/13; B61L 1/02
USPC ..... 191/23 R, 25, 29 R, 30, 32
See application file for complete search history.

(56) References Cited

U.S. PATENT DOCUMENTS

| | | | | |
|---|---|---|---|---|
| 2012/0000988 | A1* | 1/2012 | Burkhardt | E01B 21/00 238/9 |
| 2012/0305501 | A1 | 12/2012 | Lowe et al. | |
| 2015/0203332 | A1 | 7/2015 | Munter | |
| 2015/0292166 | A1* | 10/2015 | White | E01B 23/04 238/338 |

FOREIGN PATENT DOCUMENTS

| | | | |
|---|---|---|---|
| CN | 204000489 | U | 12/2014 |
| CN | 204353816 | U | 5/2015 |
| CN | 104736859 | | 6/2015 |
| DE | 4318383 | | 7/1994 |
| DE | 202010000866 | U1 | 4/2010 |
| WO | 2014/032699 | | 3/2014 |

* cited by examiner

Fig. 5
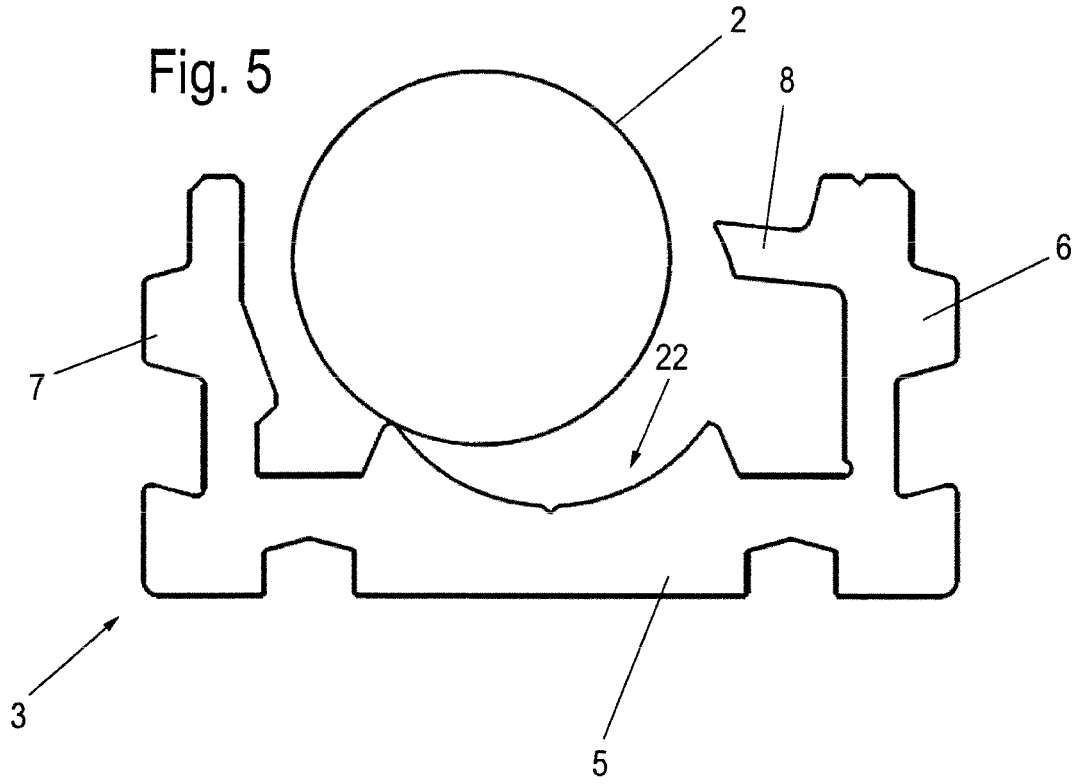
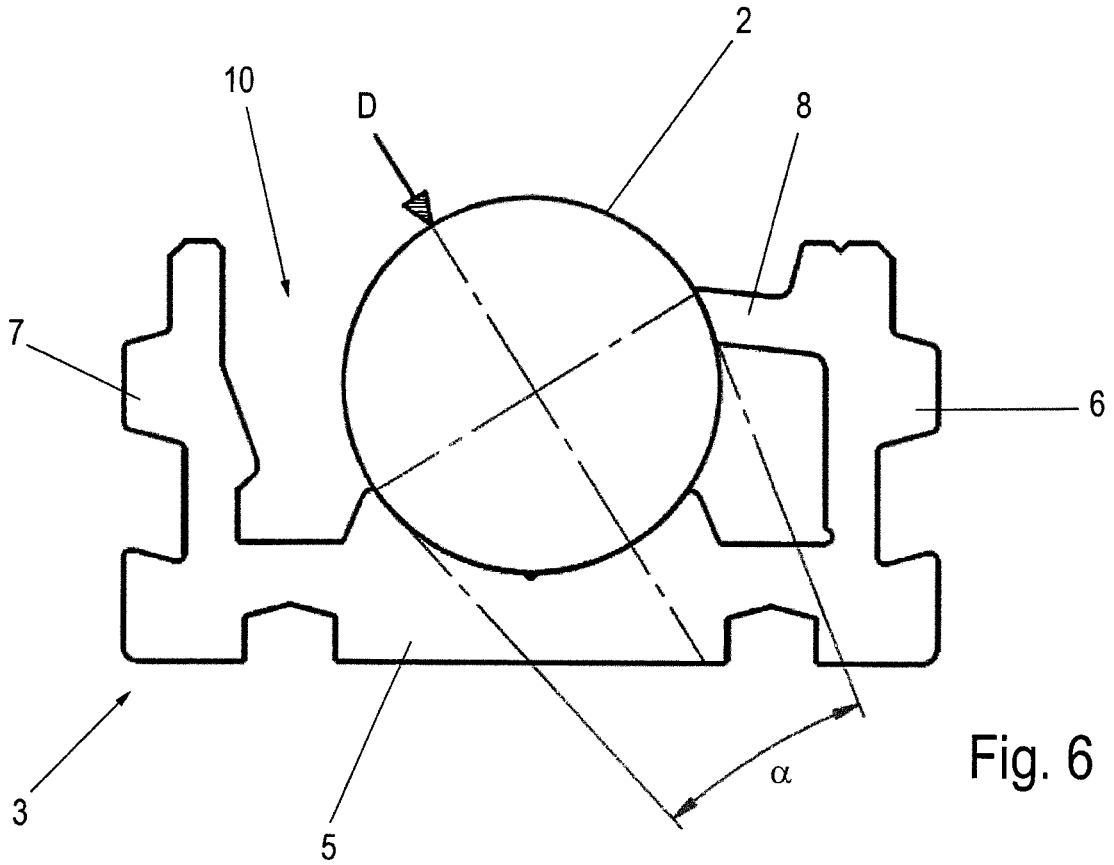
Fig. 6

PROFILED BEARING AND RAIL SYSTEM

CROSS-REFERENCE TO RELATED APPLICATIONS

This application is a U.S. nationalization under 35 U.S.C. § 371 of International Application No. PCT/EP2017/055688, filed Mar. 10, 2017, which claims priority to German Patent Application No. 10 2016 106 941.8, filed Apr. 14, 2016. The disclosures set forth in the referenced applications are incorporated herein by reference in their entireties.

BACKGROUND AND SUMMARY OF THE INVENTION

The present disclosure relates to a profiled bearing for a rail and a rail system.

Generic profiled bearings for rails, in particular rails with a circular cross section, are known for example from DE 43 18 383 C1 or WO 2014/032 699 A1. The profiled bearings disclosed therein consist essentially of a U-shaped base profile with two side walls and a base connecting the side walls with a bearing bed, in which the rail rests. The distance between the two side walls is greater in this case than the diameter or the width of the rail, so that two profiled clamping sections are provided for fixing the rail in the profiled bearing, which are inserted into the gaps between the rail and a respective side wall of the base profile.

Such profiled bearings have proven themselves in practice quite well. A disadvantage is the relatively time-consuming installation in particular of the two profiled clamping sections to the right and left of the rail to be fixed and an occasional jumping out of the already installed first profiled clamping section when installing the second profiled clamping section and jumping out of the profiled clamping sections when moving heavy loads on the rail system.

The present disclosure is directed to a profiled bearing and a rail system, which allows the installation and fixing of the rail in such a profiled bearing in a time-saving manner and ensures a permanently tight fit.

A profiled bearing according to the present disclosure has a profiled base with a first side wall, a second side wall and a base connecting a first end of the first side wall to a first end of the second side wall and a profiled clamping section.

The base and the side walls form a receiving pocket for receiving the rail.

The profiled clamping section is in a functional position in which the rail is clamped to the profiled bearing, pressed in a gap between the rail inserted into a bearing bed of the base and the second side wall.

The profiled clamping section is in a functional position in which the rail is clamped to the profiled bearing, pressed in a gap between the rail inserted into a bearing bed of the base and the second side wall.

In the region of a second end of the first side wall remote from the base, a clamping finger extending in the direction of the second side wall is formed, with which the rail can be pressed into the bearing bed of the base.

The profiled clamping section has a base web with two clamping legs extending from one side of the base web, which can be pressed into the gap between the rail inserted in the bearing bed and the second side wall.

The clamping legs of the profiled clamping section extend in the direction of the bearing bed in the functional position when pressed into the gap. In this case, a first clamping leg rests at least partially against the rail. A portion of a second clamping leg is pressed into an undercut integrally formed on the second side wall.

With a profiled bearing formed in this manner, a simple and quick installation of a rail in the profiled bearing is made possible because only a profiled clamping section must be introduced between one of the side walls and the rail for the clamping of the rail in the profiled bearing.

Also, a jumping out of the profiled clamping section is avoided with the profiled bearing according to the disclosure, since only a profiled clamping section is to be used, which is pressed at force application of the rail on the profiled clamping section on the second side wall and an additional force, in addition to the tensioning force of the clamping leg, acts by reinforced frictional engagement between the adjacent surfaces of the profiled clamping section and the side wall. The rail thus cannot escape upwards.

By integrally forming the clamping finger on the first side wall, a pre-fixing of the rail in the position to be clamped in the profiled bearing is made possible.

According to an embodiment, one of the clamping legs is formed resiliently and the other of the clamping legs is formed dimensionally stable.

In an alternative embodiment, both clamping legs are resilient.

Due to the resilient design of the clamping legs of the profiled clamping section, a stronger frictional engagement is made possible between the profiled bearing and the rail due to the pressure force exerted by the profiled clamping section on the rail, which also contributes to the fixing of the rail in the longitudinal direction of the rail.

The formation of both clamping legs as resilient clamping legs also facilitates the installation of the profiled clamping section in the gap between the rail and the second side wall.

The contact surface of the second side wall and the contact surface of the base web facing the second side wall in the functional position of the profiled clamping section are formed according to a preferred embodiment variant as flat surfaces, whereby the production of the profiled base and the profiled clamping section and the installation of the profiled clamping section are facilitated.

According to a further embodiment, a pressure surface of the base web of the profiled clamping section facing the rail and facing away from the second side wall in the functional position is adapted to the outer contour of the rail. As a result, a wedge effect between the rail and the profiled base of the profiled bearing is effected.

According to a further embodiment, a portion of a side surface of the first clamping leg facing the rail is designed as a raised pressure region touching the rail. As a result, the rail is also fixed in a lower region near the base between the first clamping leg and the preferably approximately diagonally opposite clamping fingers of the first side wall. The pressure region of the first clamping leg is preferably below an imaginary horizontal plane that runs through the rail center point.

The raised pressure region touching the rail is preferably formed on the free end of the first clamping leg, in particular in the form of a thickening of the free end of the first clamping leg.

For the purpose of the meshing of the profiled clamping section in the gap between the second side wall of the profiled base and the rail, the portion of the second clamping leg, which can be pressed into the undercut formed on the second side wall, is integrally formed according to an embodiment on a free end of the second clamping leg, in particular in the shape of a bent portion towards the inner surface of the side wall facing receiving space.

In an embodiment, the side surface of the second clamping leg facing the second side wall follows the inner surface of the second side wall.

As a result, a solid, play-free fit of the profiled clamping section and the rail in the profiled base of the profiled bearing is made possible.

In accordance with a further embodiment, pockets extending in the longitudinal extension of the profiled bearing are integrally formed on an outer surface of the side walls facing away from the receiving space, whose side edges close to the free ends of the side walls are formed rising from a pocket base to the outside.

The pockets enable secure meshing of the profiled bearing in a floor surrounding said bearing, in particular a concrete base. The rising formation of the side edges from the pocket base to the outside prevents trapped air when casting the profiled bearing in the floor, which allows a higher strength of the profiled bearing in the floor.

BRIEF DESCRIPTION OF THE DRAWINGS

FIGS. 3 to 10 show sectional views of an alternative embodiment of a profiled bearing according to the present disclosure and a rail for illustrating the installation of the rail in the profiled bearing.

DETAILED DESCRIPTION OF THE DRAWINGS

In the following description of the figures, terms such as above, below, left, right, front, back, etc. refer exclusively to the exemplary representation and position of the profiled bearing, the rail, the profiled base, the profiled clamping section, the side wall, the base web, the clamping leg and the like chosen in the respective drawings. These terms are not intended to be limiting, i.e. by different working positions or the mirror-symmetrical design or the like, these references may change.

Figure 1:
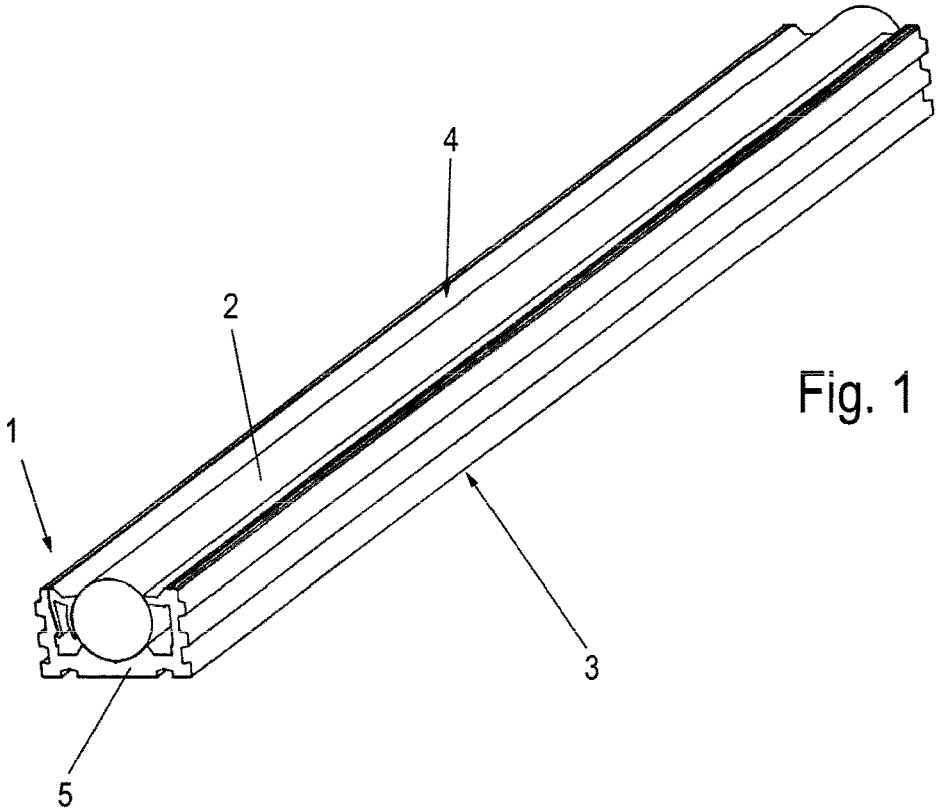
FIG. 1 shows a perspective view of a variant of a profiled bearing according to the present disclosure with a rail inserted therein.
Figure 2:
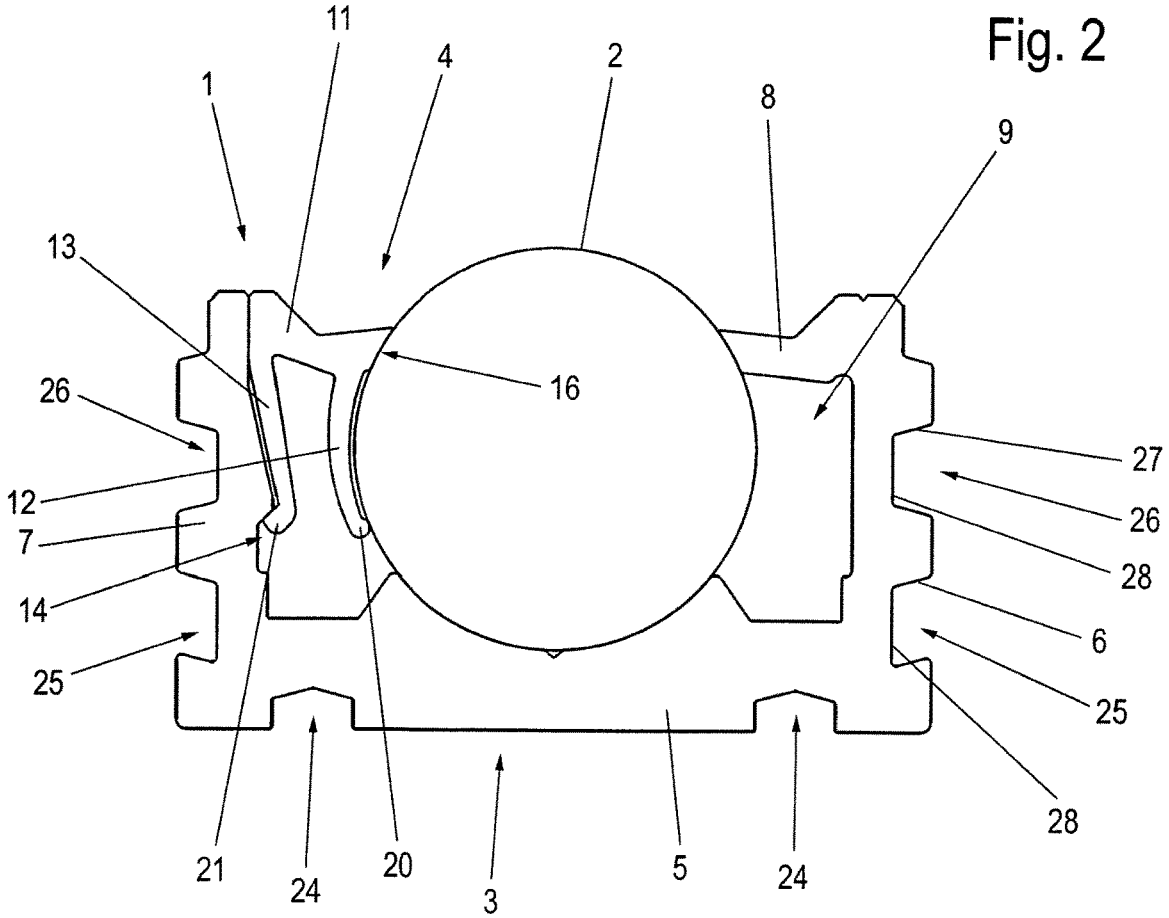
FIG. 2 shows a cross-sectional view of the profiled bearing shown in FIG. 1 with an inserted rail fixed by means of the profiled clamping section rail.

In the FIGS. 1 and 2, reference numeral 1 denotes an entirety of an embodiment of a profiled bearing according to the present disclosure. The profiled bearing 1 has an approximately U-shaped profiled base 3 with a first side wall 6, a second side wall 7 and a base 5 connecting a first end of the first side wall 6 to a first end of the second side wall 7. The length of each of the profiled bearings in the direction of the longitudinal extension of the profiled bearings or rails 2 or steel shafts held therein is preferably three meters. However, are other manufacturing dimensions are also conceivable.

For supporting a rail 2, which is designed here as a round rail with a circular cross-section, a bearing bed 22 is formed with a part-circular support surface on the base 5, which is bounded by two elevations 23 upwardly projecting from the base 5.

To tightly clamp the rail 2 in the receiving pocket 9 of the profiled bearing 1, a clamping finger 8 extending in the direction of the second side wall 7 is integrally formed in the region of a second end of the first side wall 6 remote from the base 5.

Figure 3:
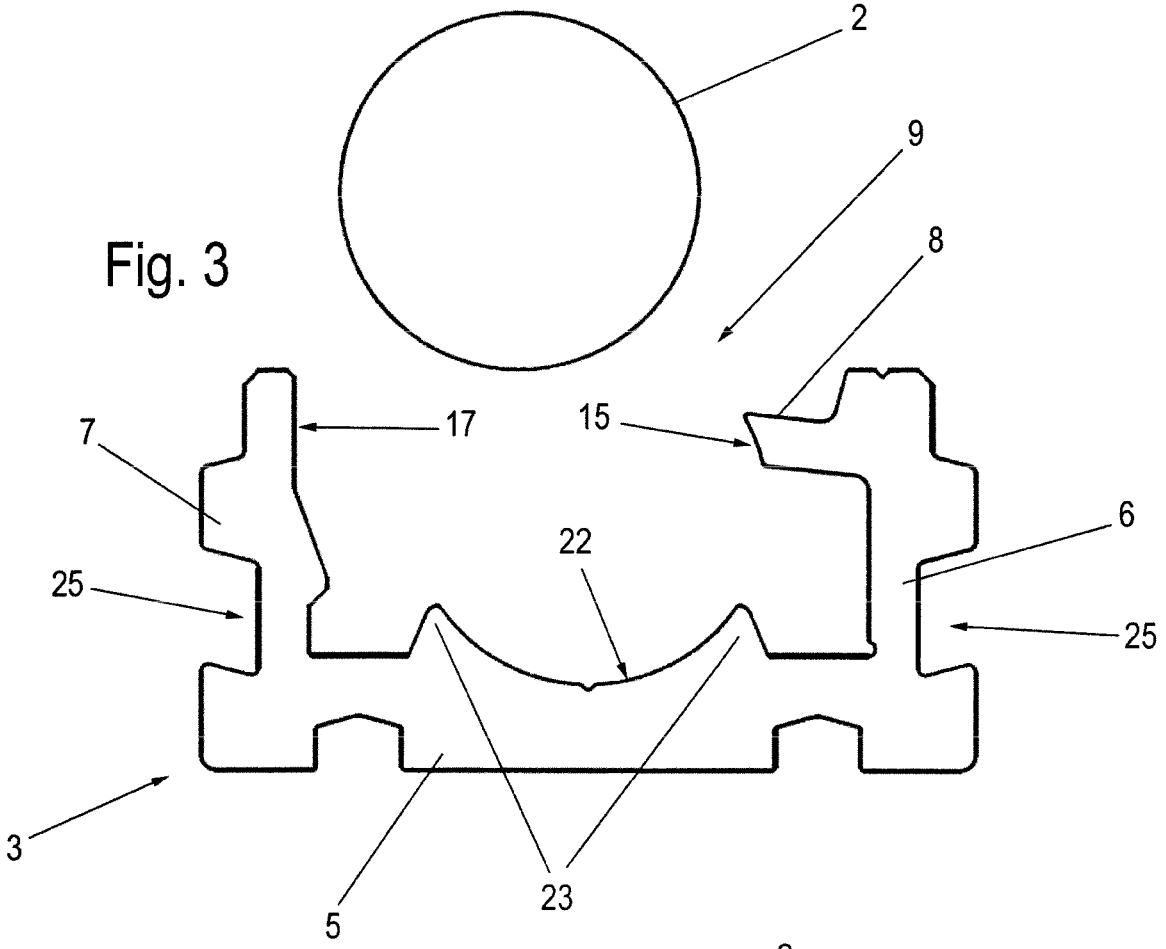

For example, as shown in FIG. 3, the clamping finger 8 has, at its end facing the rail 2, a pressure surface 15 adapted to the outer contour of the rail 2. The pressure surface 15 is adapted in the embodiment shown here to the base rail 2 in a concave manner with a bending radius adapted to the outer surface of the rail 2.

The pressure surface 15 lies in the state of the rail 2 inserted into the bearing bed 22 of the base 5 in a peripheral portion of an upper half of the rail 2. Accordingly, a peripheral portion of the lower half of the rail 2 is covered by the bearing bed 22 of the base 5.

The orientation of the clamping finger 8 relative to the bearing bed 22 of the base 5 is such that when inserting the rail 2 in the bearing bed 22, as shown in FIGS. 3 to 6, the rail 2 must be inserted with slight pressure against the pressure surface 15 of the clamping finger 8 and into the bearing bed 22 of the base 5, wherein the clamping finger 8 and/or the first side wall 6 bends slightly resiliently outward, i.e. away from the center of the receiving pocket 9.

For prefixing of the rail 2 between the clamping finger 8 and the bearing bed 22 of the base 5, a receiving angle $\alpha$ indicated in FIG. 6 is formed as small as possible between the pressure surface 15 of the clamping finger 8 and the bearing bed 22 in the region of the top of the elevation 23 close to the second side wall 7. The receiving angle $\alpha$ is in particular less than 30°.

As a result, when the rail 2 is inserted into the bearing bed 22, pressure is always exerted on the rail 2 by the clamping finger 8, thus producing an increased frictional engagement between rail 2 and the pressure surface 15 of the clamping finger 8 and the bed 22 of the base 5. In addition, the freedom of movement of the rail 2 away from the base 5 in the upward direction is thus already severely limited by the interaction of the clamping finger 8 with the bearing bed 22.

In a gap between the rail 2 and the second side wall 7, a profiled clamping section 4 is clamped or pressed in the mounted state of the rail 2 in the profiled bearing 1.

This profiled clamping section 4 has a base web 11 with two clamping legs 12, 13 extending from one side of the base web 11.

The clamping legs 12, 13 of the profiled clamping section 4 extend in the direction of the base 5 in the functional position when pressed into the gap 10. Here, a first clamping leg 12 rests at least partially against the rail 2. In this case, a portion of a second clamping leg 13 is pressed into an undercut 14 integrally formed on the second side wall 7.

In the functional position, the base web 11 of the profiled clamping section 4 closes the gap 10 between an upper free end of the second side wall 7 and the rail 2.

The clamping legs 12, 13 may be formed resiliently.

It is also conceivable to form one of the clamping legs 12, 13 in a dimensionally stable manner, which is also possible for insertion of the profiled clamping section 4 into the gap 10 when the rail 2 has already been inserted into the receiving pocket 9.

The profiled bearing 1 may be formed entirely or partially as an aluminum profile. However, it is also conceivable to provide production from another metal or a suitable plastic or composite material.

To achieve a wedge effect between the rail 2 and the profiled clamping section 4, as shown in FIGS. 2 to 10, a contact surface 17 of the second side wall 7 and a contact surface 18 of the base web 11 facing the second side wall 7 in the functional position of the profiled clamping section 4 are formed as a flat surface.

Furthermore, a pressure surface 16 of the base web 11 of the profiled clamping section 4 facing away from the second side wall 7 in the functional position and facing the rail 2 is formed to be adapted to the outer contour of the rail 2. In the embodiment of the rail 2 as a round rail, the pressure surface 16 of the base web 11 is designed accordingly as a concave pressure surface with a bending radius corresponding to the lateral surface of the rail 2.

To create a second pressure point of the first clamping leg 12 on the rail 2, a portion of the side surface of the first clamping leg 12 facing the rail 2 is formed as a raised pressure region touching the rail 2, in particular in the form of a pressure surface or a pressure edge.

As shown in FIGS. 2 and 7 to 10, this pressure region may be integrally formed on the free end 20 of the first clamping leg 12. In this case, a cavity is formed between the free end 20 and the pressure surface 16 of the base web 11.

In the state of the rail 2 when inserted into the bearing bed 22 of the base 5, the pressure region at the free end 20 of the first clamping leg 12 lies in this case in a peripheral portion of a lower half of the rail 2 close to the bearing bed 22 of the base 5.

For fixing or meshing of the profiled clamping section 4 in the gap 10, the section of the second clamping leg 13, which can be pressed into the undercut 14 integrally formed on the second side wall 7, is integrally formed on a free end 21 of the second clamping leg 13. It is also conceivable, in accordance with an undercut in the second side wall 7 provided further above, i.e. further away from the base 5, to form a corresponding projection on the second clamping leg 13 between its free end 21 and the base web 11.

The undercut 14 may be formed, as can be clearly seen in FIG. 2, by a nose 19 projecting in a manner of a ramp into the receiving space 9 through an inner surface of the second side wall 7 facing the receiving space 9.

The inner surface of the second side wall 7 extends from the undercut 14 according to one embodiment straight towards the base 5, as shown in FIGS. 3 to 10. This embodiment is particularly suitable for rails 2 of smaller cross section, for example, cross-sections in a range of 20 to 30 mm.

For rails 2 of larger cross-section, for example in a range of 30 to 50 or more millimeters, the inner surface of the second side wall 7 may also be formed stepped, wherein the second side wall 7 is formed towards the base 5 with a step projecting into the receiving space 9, as shown by way of example in FIG. 2.

The second clamping leg 13, in its longitudinal extension from the base web 11 to its free end 21, may follow the inner surface of the second side wall 7. Accordingly, the second clamping leg 13, in the embodiment shown here, is designed such that it extends from the base web 11 in the direction of its free end 21 in a straight line, wherein the free end 21 of the second clamping leg 13 is formed bent towards the second side wall 7 at an angle.

Figure 4:
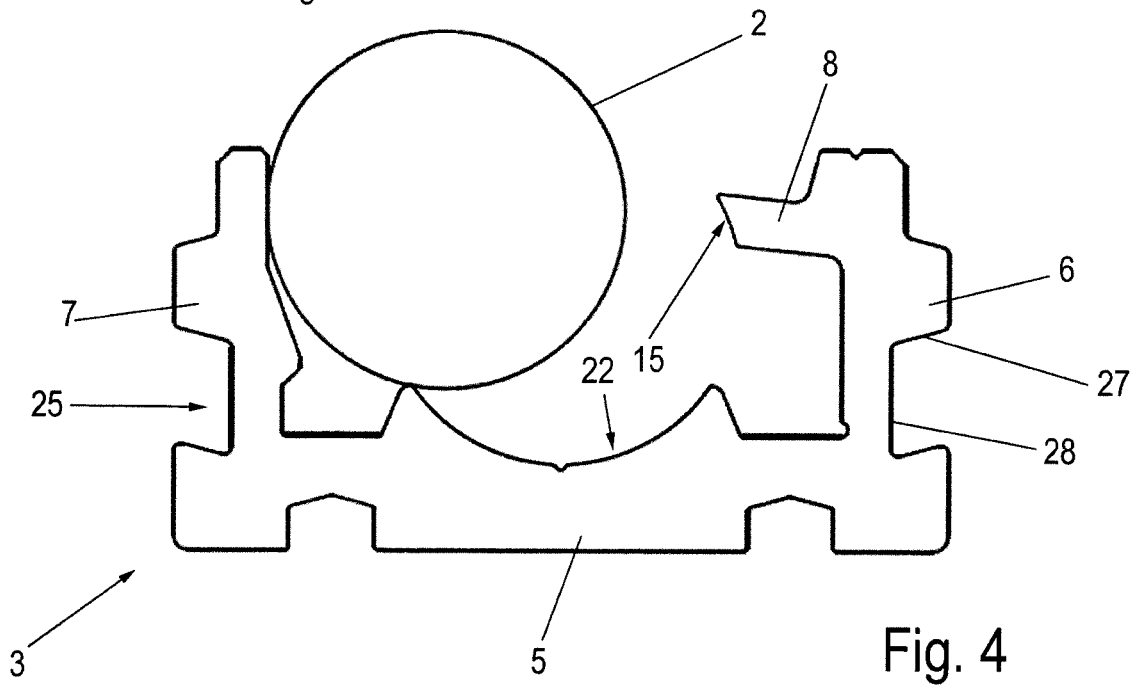

When mounting the rail system, first, as shown in FIGS. 3 and 4, the rail 2 is inserted from above into the receiving pocket 9 formed by the side walls 6, 7 and the base and then moved diagonally from a position close to the second side wall, while exercising a pressure D, against the clamping finger 8 in the bearing bed 22, as shown in FIGS. 5 and 6.

Figure 7:
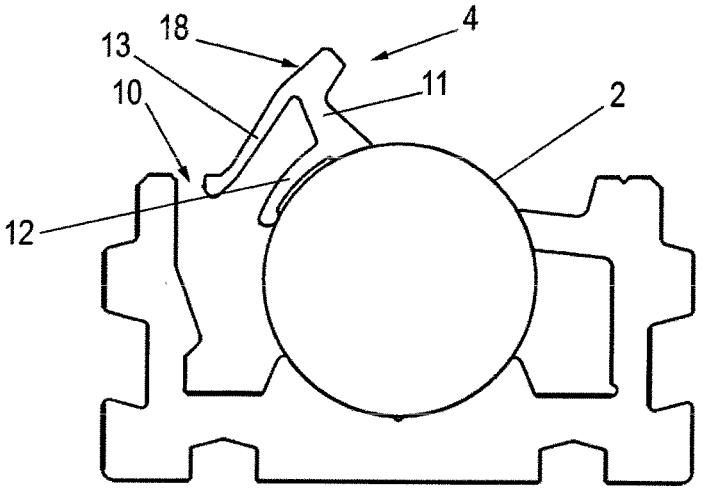

Subsequently, as shown in FIG. 7, the profiled clamping section 4 is pressed into the gap 10 between the upper free end of the second side wall 7 and the rail 2.

Figure 8A:
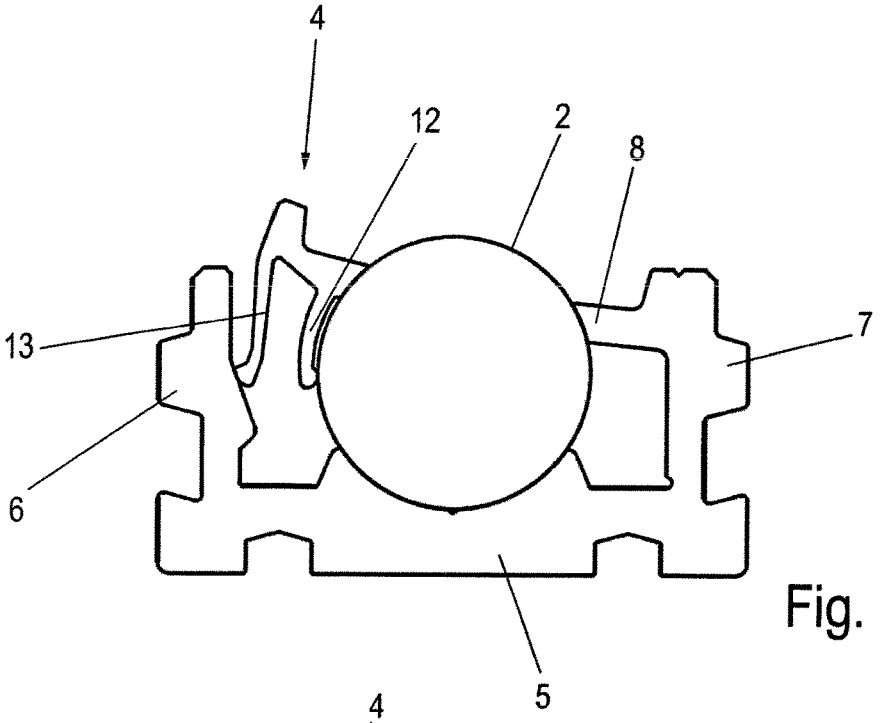

As shown in FIG. 8*a*, the profiled clamping section 4 can be placed in this case with the free end of the first clamping leg 12 and the pressure surface 16 of the base web 11 on the rail 2 and pressed along the lateral surface of the rail 2 in the direction of the base 5 of the profiled base 3.

Figure 8B:
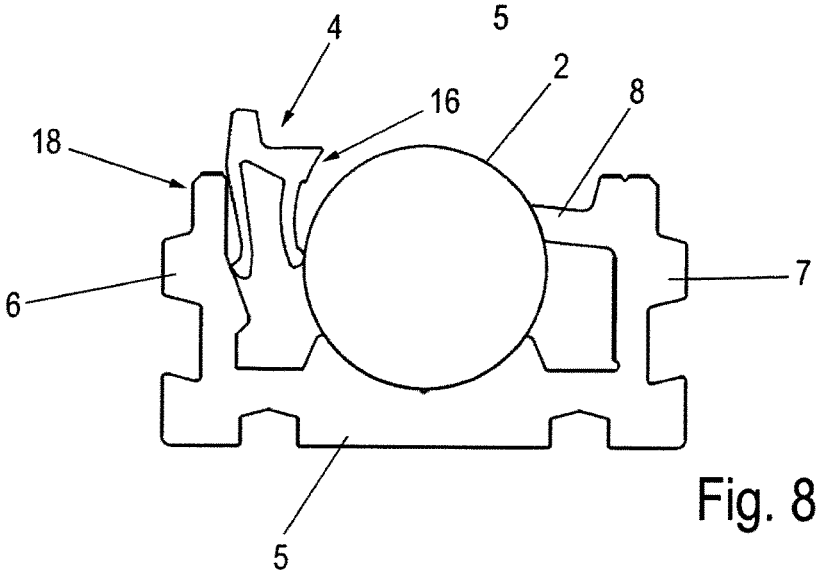
Figure 9:
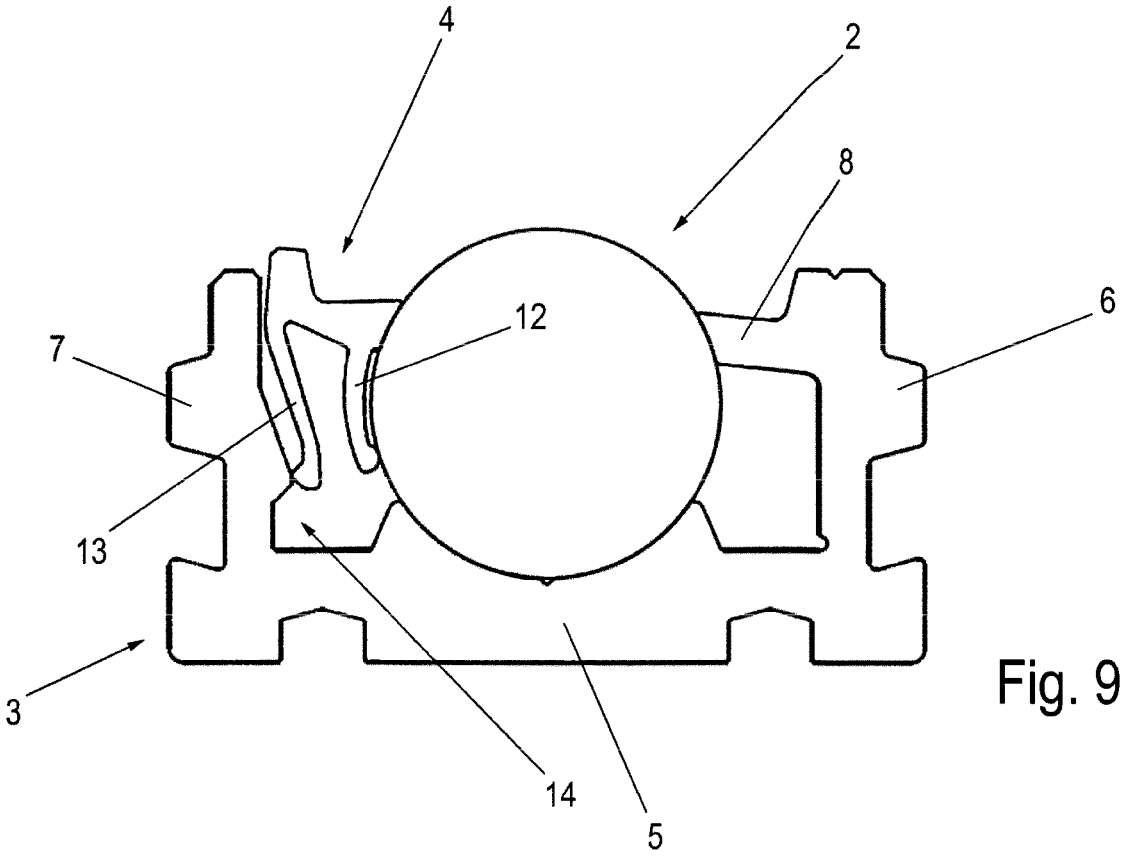
Figure 10:
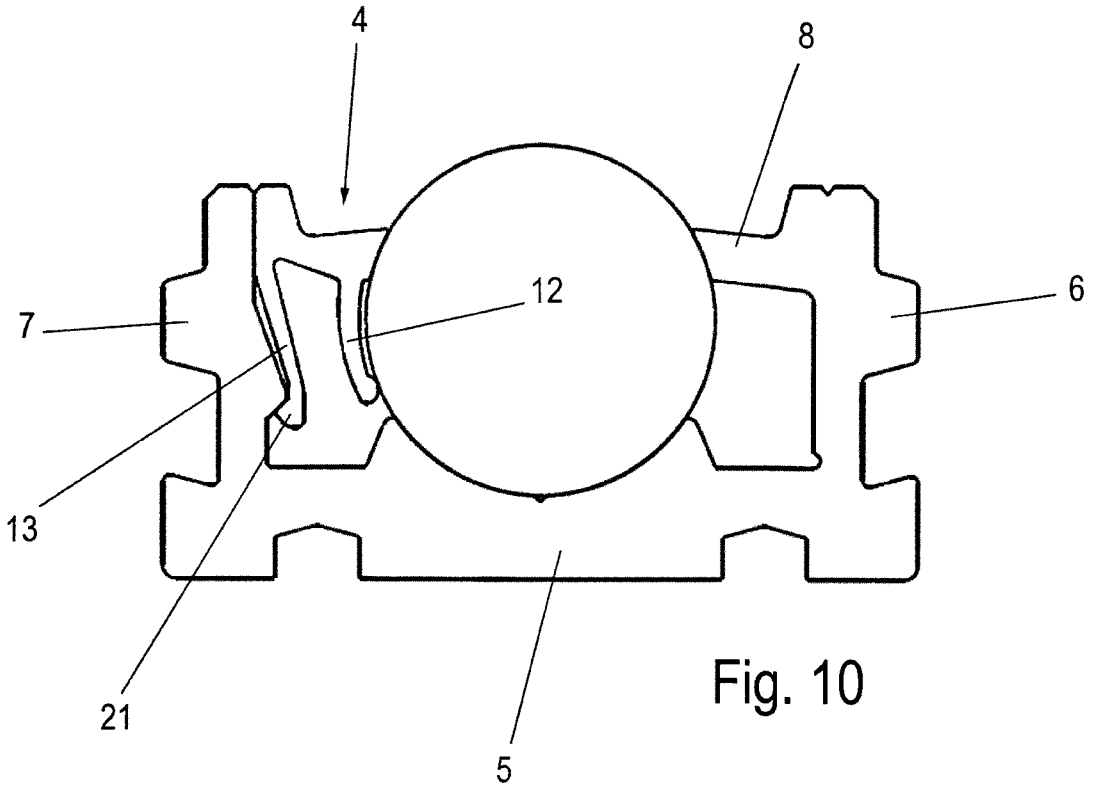

Alternatively, the profiled clamping section 4, as shown in FIG. 8*b*, can be inserted or pressed approximately vertically downwards in the direction of the base 5 of the profiled base 3 into the gap 10, wherein initially the free end 20 of the first clamping leg comes into contact with the rail 2, wherein the clamping legs 12, 13 are pressed resiliently to each other during further inward pressing in the direction of the base 5 until the free end of the second clamping leg has passed the nose 19 protruding into the receiving space 9 on the inner surface of the second side wall 7 facing the receiving space 9 and moves into the undercut 14 under spring compression, as shown in FIGS. 9 and 10.

The rail 2 of a rail system with a profiled bearing 1 as described above can not escape upwards in the assembly, since it has the tendency by the clamping fingers 8 of the first side wall 6 of the profiled base 3 under load to migrate laterally in the direction of the second side wall 7 or of the profiled clamping section 4.

However, this movement is counteracted by the profiled clamping section 4, since it is supported laterally on the second side wall 7 of the profiled base 3 and the acting frictional forces of the pressure surface 16, the pressure region and in particular the contact surface 18 of the profiled clamping section 4 and the meshing in the lower region prevent the profiled clamping section 4 and thus the rail 2 from being levered out.

For fixing the profiled base 3 of the profiled bearing 1 in a floor of a warehouse or the like, a plurality of grooves 24 are integrally formed on the outer surfaces of the profiled base 3 in the region of the base 5 and pockets 25, 26 in the region of the side walls 6, 7.

The pockets 25, 26 in the side walls 6, 7 may be formed with a trapezoidal cross-section. In particular, the free ends of the side walls 6, 7 near side edges 27 are formed by a vertically oriented pocket base 28 rising to the outside so that during the casting of the profiled base 3 in the floor, e.g. via liquid concrete or grout, no air pockets, so-called voids, can arise, thus increasing the strength of the overall system.

The invention claimed is:

1. A profiled bearing for a rail, comprising a profiled base having a first side wall, a second side wall and a base connecting a first end of the first side wall to a first end of the second side wall, and a profiled clamping section, wherein the base and the side walls form a receiving pocket for receiving the rail, wherein the profiled clamping section is clamped in a functional position in a gap between the rail inserted in a bearing bed of the base and the second side wall, wherein in a region of a second end of the first side wall remote from the base, a clamping finger extending in a direction toward the second side wall is integrally formed, with which clamping finger the rail can be pressed into the bearing bed, wherein the profiled clamping section has a base web with two clamping legs extending from one side of the base web, which profiled clamping section can be pressed into the gap between the rail inserted in the bearing bed and the second side wall, and wherein the clamping legs of the profiled clamping section, in the functional position when pressed into the gap, extend in a direction toward the bearing bed, wherein a first clamping leg rests at least partially against the rail and a portion of a second clamping leg is pressed into an undercut integrally formed on the second side wall.

2. The profiled bearing according to claim 1, wherein one of the clamping legs is formed resiliently and the other of the clamping legs is formed dimensionally stable.

3. The profiled bearing according to claim 1, wherein both clamping legs are formed resiliently.

4. The profiled bearing according to claim 1, wherein each of a contact surface of the second side wall and a contact surface of the base web facing the second side wall in the functional position of the profiled clamping section is formed as a flat surface.

5. The profiled bearing according to claim 1, wherein a pressure surface of the base web of the profiled clamping section facing the rail and facing away from the second side wall in the functional position is formed to be adapted to an outer contour of the rail.

6. The profiled bearing according to claim 1, wherein a portion of a side surface of the first clamping leg facing the rail is formed as a raised pressure region touching the rail.

7. The profiled bearing according to claim 6, wherein the raised pressure region touching the rail is integrally formed on a free end of the first clamping leg.

8. The profiled bearing according to claim 1, wherein the portion of the second clamping leg, which can be pressed into the undercut integrally formed on the second side wall, is integrally formed on a free end of the second clamping leg.

9. The profiled bearing according to claim 1, wherein the undercut is formed on an inner surface of the second side wall facing the receiving pocket by a nose projecting in a manner of a ramp into the receiving pocket.

10. The profiled bearing according to claim 9, wherein a side surface of the second clamping leg facing the second side wall is formed to follow the inner surface of the second side wall.

11. The profiled bearing according to claim 1, wherein pockets extending in a longitudinal extension of the profiled bearing are integrally formed on outer surfaces of the side walls facing away from the receiving pockets, wherein side edges of the side walls close to free ends of the side walls are formed to rise upwardly and outwardly from pocket bases of the pockets.

12. A rail system having a profiled bearing according to claim 1 and a rail received in the profiled bearing.

* * * * *